US006004674A

United States Patent [19]

Kent et al.

[11] Patent Number: 6,004,674

[45] Date of Patent: Dec. 21, 1999

[54] BICOMPONENT FIBERS HAVING CONTAMINANT-CONTAINING CORE DOMAIN AND METHODS OF MAKING THE SAME

[75] Inventors: Diane R. Kent; Matthew B. Hoyt, both of Arden; Otto M. Ilg, Asheville; Morris K. Queen, Clyde, all of N.C.

[73] Assignee: BASF Corporation, Mt.Olive, N.J.

[21] Appl. No.: 09/216,677

[22] Filed: Dec. 18, 1998

Related U.S. Application Data

[62] Division of application No. 08/998,830, Dec. 29, 1997, Pat. No. 5,885,705

[60] Provisional application No. 60/034,745, Jan. 10, 1997.

[51] Int. Cl.[6] ..... D02G 3/00

[52] U.S. Cl. ..... 428/373; 428/374

[58] Field of Search ..... 428/373, 374

[56] References Cited

U.S. PATENT DOCUMENTS

| | | | |
|---|---|---|---|
| 3,803,453 | 4/1974 | Hull | 317/2 |
| 4,069,363 | 1/1978 | Segraves et al. | 428/224 |
| 4,473,617 | 9/1984 | Van Leeuwen et al. | 428/373 |
| 5,125,818 | 6/1992 | Yeh | 425/131.5 |
| 5,162,074 | 11/1992 | Hills | 156/644 |
| 5,272,005 | 12/1993 | Collier et al. | 428/373 |
| 5,344,297 | 9/1994 | Hills | 425/131.5 |
| 5,437,918 | 8/1995 | Taniguchi et al. | 428/224 |
| 5,445,884 | 8/1995 | Hoyt et al. | 428/370 |
| 5,457,197 | 10/1995 | Sifniades et al. | 540/540 |
| 5,549,957 | 8/1996 | Negola et al. | 428/92 |
| 5,681,952 | 10/1997 | Sifniades et al. | 540/540 |

FOREIGN PATENT DOCUMENTS

| | | | |
|---|---|---|---|
| 6-184863 | 11/1992 | Japan | D03D 27/00 |

*Primary Examiner*—Newton Edwards
*Attorney, Agent, or Firm*—Laura D. Nammo

[57] ABSTRACT

Novel bicomponent fibers have a polyamide domain and a contaminant-containing polymer domain which is embedded entirely within, and thereby completely surrounded by, the polyamide domain. The preferred bicomponent fibers have a sheath-core structure wherein the polyamide domain constitutes the sheath and the contaminant-containing polymer constitutes the core. Surprisingly, even though the core is formed of a contaminant-containing polymer (which is difficultly spinnable), the bicomponent fibers are readily spinnable and exhibit properties which are comparable in many respects to fibers formed from 100% polyamide. Preferably, the fibers are concentric sheath-core bicomponent fibers having an uncontaminated nylon-6 sheath and a core formed from nylon-6 having a relatively high level of contamination in the form of the cyclic dimer of caprolactam and/or nylon-6 derived from colored regenerated post-consumer nylon carpet fibers.

14 Claims, No Drawings

BICOMPONENT FIBERS HAVING CONTAMINANT-CONTAINING CORE DOMAIN AND METHODS OF MAKING THE SAME

CROSS-REFERENCE TO RELATED APPLICATION

This application is a divisional of application Ser. No. 08/998,830, filed Dec. 29, 1997 now U.S. Pat. No. 5,885,705. This application is related to, and claims domestic priority benefits from, U.S. Provisional patent application Ser. No. 60/034,745 filed on Jan. 10, 1997, the entire content of which is expressly incorporated hereinto by reference.

FIELD OF INVENTION

The present invention relates generally to the field of synthetic fibers. More particularly, the present invention relates to synthetic bicomponent fibers having a sheath-core structure. In particularly preferred forms, the present invention is embodied in multi-lobal bicomponent fibers having a polyamide sheath entirely surrounding a core formed of a contaminant-containing polymeric material.

BACKGROUND AND SUMMARY OF THE INVENTION

Polyamide has been utilized extensively as a synthetic fiber. While its structural and mechanical properties make it attractive for use in such capacities as carpeting, it is nonetheless relatively expensive. It would therefore be desirable to replace a portion of polyamide fibers with a core formed from a relatively lower cost material.

In this regard, some polymeric materials that are attractive candidates as a partial replacement of the polyamide are "off-specification"—that is, contain a contaminant. For example, "off-specification" nylon-6 having relatively high levels of the cyclic dimer of caprolactam is particularly troublesome when attempted to be melt-spun. Such "off-specification" nylon 6 can be obtained from a number of sources due, for example, to its being manufactured with methods that produce high levels of the cyclic dimer contaminant, or have avoided (or minimally exposed) to a dimer extraction step. However, replacing a portion of a 100% polyamide fiber with a core portion of a contaminant material may affect the mechanical properties of the fiber to an extent that it would no longer be useful in its intended end-use application (e.g., as a carpet fiber).

Furthermore, many regenerated polymeric materials are already colored (e.g., by use of a colorant or dye). Therefore, their use as a material to make useful products (e.g., carpet fibers) is usually limited by the color of the regenerated polymeric materials that may be obtained. Typically, only clear regenerated polymeric materials are employed for such purposes since the manufacturer can then add pigments or dyes to provide products of desired color.

Recently, U.S. Pat. No. 5,549,957 has proposed multi-lobal composite fibers having a nylon sheath and a core of a fiber-forming polymer which can be, for example, "off spec" or reclaimed polymers. (Column 4, lines 6–8.) The core can be polypropylene, polyethylene terephthalate, high density polyethylene, polyester or polyvinyl chloride. (Column 4, lines 17–20.) The core is covered with a sheath of virgin nylon which constitutes between 30% to 50% by weight of the core/sheath fiber. (Column 3, lines 65–67.)

The presently known prior art therefore evidences the fact that contaminant-containing polymeric materials— particularly, nylon-6 having a relatively high level of the cyclic dimer of caprolactam—have not been employed as a structural component of finished bicomponent synthetic fiber structures.

Broadly, the present invention relates to a bicomponent fiber structure having a polyamide domain and another distinct cross-sectional domain formed of polymeric material having a relatively high level of contaminant. The contaminant-containing polymeric domain is embedded entirely within, and thus completely surrounded by, the polyamide domain. Preferably, the fibers of this invention have a concentric sheath-core structure whereby the polyamide domain forms the sheath and the contaminant polymer forms the core. Surprisingly, even though the core is formed of a polymer having relatively high levels of contaminant, the bicomponent sheath-core fibers of this invention exhibit properties which are comparable in many respects to fibers formed from 100% (virgin) polyamide.

In another aspect, the present invention relates to a bicomponent fiber structure having a polyamide domain and another distinct cross-sectional domain formed of a regenerated colored polymeric material. The regenerated polymeric domain is embedded entirely within, and thus completely surrounded by, the polyamide domain. Preferably, the fibers of this invention have a concentric sheath-core structure whereby the polyamide domain forms the sheath and the regenerated polymer forms the core. Surprisingly, even though the core is formed of a regenerated colored polymeric material, the bicomponent sheath-core fibers of this invention exhibit properties which are comparable in many respects to fibers formed from 100% (virgin) polyamide. For example, the virgin polymer sheath component of the bicomponent fibers of this invention can be colored to an extent that the colored regenerated polymeric core material in the core is "hidden".

A further aspect of this invention is that the colored regenerated polymeric material be blended with a color-leveler—for example, a black pigment, such a carbon black. In this regard, it is known that most regenerated (recycled) polymeric materials will have some color variation, typically a shade of gray-green. According to the present invention, therefore, the regenerated colored polymeric material would first be measured against a known color standard. A specified amount of a color leveler (e.g., carbon black) would then be added to the regenerated colored polymeric material to correct its color to the known standard. Thereafter, the color-corrected regenerated polymeric material may be incorporated into the core of a sheath-core fiber according to this invention.

These, as well as other aspects and advantages of this invention, will become more apparent after careful consideration is given to the following detailed description of the preferred exemplary embodiments thereof.

DETAILED DESCRIPTION OF THE PREFERRED EXEMPLARY EMBODIMENTS

As used herein and in the accompanying claims, the term "fiber-forming" is meant to refer to at least partly oriented, partly crystalline, linear polymers which are capable of being formed into a fiber structure having a length at least 100 times its width and capable of being drawn without breakage at least about 10%. The term "non-fiber-forming" is therefore meant to refer to polymers which may be formed into a fiber structure, but which are incapable of being drawn without breakage at least about 10%.

The term "fiber" includes fibers of extreme or indefinite length (filaments) and fibers of short length (staple). The term "yarn" refers to a continuous strand or bundle of fibers.

The term "bicomponent fiber" is a fiber having at least two distinct cross-sectional domains respectively formed of different polymers. The term "bicomponent fiber" is thus intended to include concentric and eccentric sheath-core fiber structures and island-in-sea fiber structures. Preferred according to the present invention are concentric bicomponent sheath-core fiber structures having a polyamide sheath and a contaminant-containing polymer core, and thus the disclosure which follows will be directed to such a preferred embodiment. However, the present invention is equally applicable to other bicomponent fiber structures having a polyamide domain and a non-fiber-forming contaminant-containing polymer domain embedded entirely within, and thus completely surrounded by, the polyamide domain.

The term "linear polymer" is meant to encompass polymers having a straight chain structure wherein less than about 10% of the structural units have side chains and/or branches.

The terms "contaminated" and "uncontaminated" refer to a difference in the presence of an undesirable contaminant component wherein the "uncontaminated" material has less than 80% of the component present than the "contaminated" material. Furthermore, the "uncontaminated" material when spun as a single component fiber forming resin exhibits 50% less spinning interruptions than the "contaminated material" when spun into a similar fiber. In this regard, a spinning interruption is an event in the extrusion of fiber of filaments wherein the continuous production of fiber or filaments is interrupted. One major cause is threadline instability due to deposits on the spinneret face. Such events reduce the capacity of spinning equipment, produce waste, and often result in less than full yarn packages.

The term "regenerated polymer" is meant to refer to recycled post-consumer polymeric waste materials which are, in and of themselves, non-fiber-forming. Thus, a "regenerated polymer" in accordance with the present invention is encompassed within the definition of a contaminant component.

The preferred polyamides useful to form the sheath of the bicomponent fibers of this invention are those which are generically known by the term "nylon" and are long chain synthetic polymers containing amide (—CO—NH—) linkages along the main polymer chain. Suitable melt spinnable, fiber-forming polyamides for the sheath of the sheath-core bicomponent fibers according to this invention include those which are obtained by the polymerization of a lactam or an amino acid, or those polymers formed by the condensation of a diamine and a dicarboxylic acid. Typical polyamides useful in the present invention include nylon 6, nylon 6/6, nylon 6/9, nylon 6/10, nylon 6T, nylon 6/12, nylon 11, nylon 12, nylon 4,6 and copolymers thereof or mixtures thereof. Polyamides can also be copolymers of nylon 6 or nylon 6/6 and a nylon salt obtained by reacting a dicarboxylic acid component such as terephthalic acid, isophthalic acid, adipic acid or sebacic acid with a diamine such as hexamethylene diamine, methaxylene diamine, or 1,4-bisaminomethylcyclohexane. Preferred are poly-ε-caprolactam (nylon 6) and polyhexamethylene adipamide (nylon 6/6). Most preferred is nylon 6.

Importantly, the core of the sheath-core fibers according to this invention is formed of a polymeric material which contains relatively high levels of contaminants. Most preferably, the contaminant-containing polymer forming the core of the sheath-core fibers is compatible with the polyamide sheath. For example, if uncontaminated nylon-6 is employed as the sheath polymer then contaminate-containing nylon-6 is employed as the core polymer. The amount of contaminant in the core polymer should be at least about three times greater than any residual contaminants that may be present in the sheath polymer.

The core will preferably represent about 50% or greater by weight of the total bicomponent fiber weight according to this invention, with the sheath representing about 50 wt. % or less. Surprisingly, when the core is formed of contaminated nylon-6 and represents about 80 wt. % of the bicomponent fiber, physical attributes comparable to fibers formed of 100% nylon-6 are achieved.

The sheathcore fibers are spun using conventional fiber-forming equipment. Thus, for example, separate melt flows of the sheath and core polymers may be fed to a conventional sheath-core spinneret pack such as those described in U.S. Pat. Nos. 5,162,074, 5,125,818, 5,344,297 and 5,445,884 (the entire content of each patent being incorporated expressly hereinto by reference) where the melt flows are combined to form extruded multi-lobal (e.g., tri-, tetra-, penta- or hexalobal) fibers having sheath and core structures. Preferably, the fibers have a trilobal structure with a modification ratio of at least about 2.0, more preferably between 2.2 and 4.0. In this regard, the term "modification ratio" means the ratio $R_1/R_2$, where $R_2$ is the radius of the largest circle that is wholly within a transverse cross-section of the fiber, and $R_1$ is the radius of the circle that circumscribes the transverse cross-section.

The extruded fibers are quenched, for example with air, in order to solidify the fibers. The fibers may then be treated with a finish comprising a lubricating oil or mixture of oils and antistatic agents. The thus formed fibers are then combined to form a yarn bundle which is then wound on a suitable package.

In a subsequent step, the yarn is drawn and texturized to form a bulked continuous fiber (BCF) yarn suitable for tufting into carpets. A more preferred technique involves combining the extruded or as-spun fibers into a yarn, then drawing, texturizing and winding into a package all in a single step. This one-step method of making BCF is generally known in the art as spin-draw-texturing (SDT).

Nylon fibers for the purpose of carpet manufacturing have linear densities in the range of about 3 to about 75 denier/filament (dpf) (denier=weight in grams of a single fiber with a length of 9000 meters). A more preferred range for carpet fibers is from about 15 to 28 dpf.

The BCF yarns can go through various processing steps well known to those skilled in the art. For example, to produce carpets for floor covering applications, the BCF yarns are generally tufted into a pliable primary backing. Primary backing materials are generally selected from woven jute, woven polypropylene, cellulosic nonwovens, and nonwovens of nylon, polyester and polypropylene. The primary backing is then coated with a suitable latex material such as a conventional styrene-butadiene (SB) latex, vinylidene chloride polymer, or vinyl chloride-vinylidene chloride copolymers. It is common practice to use fillers such as calcium carbonate to reduce latex costs. The final step is to apply a secondary backing, generally a woven jute or woven synthetic such as polypropylene. Preferably, carpets for floor covering applications will include a woven polypropylene primary backing, a conventional SB latex formulation, and either a woven jute or woven polypropylene secondary carpet backing. The SB latex can include calcium carbonate filler and/or one or more the hydrate materials listed above.

While the discussion above has emphasized the fibers of this invention being formed into bulked continuous fibers for purposes of making carpet fibers, the fibers of this invention can be processed to form fibers for a variety of textile applications. In this regard, the fibers can be crimped or otherwise texturized and then chopped to form random lengths of staple fibers having individual fiber lengths varying from about 1½ to about 8 inches.

The fibers of this invention can be dyed or colored utilizing conventional fiber-coloring techniques. For example, the fibers of this invention may be subjected to an acid dye bath to achieve desired fiber coloration. Alternatively, the nylon sheath may be colored in the melt prior to fiber-formation (i.e., solution dyed) using conventional pigments for such purpose.

A further understanding of this invention will be obtained from the following non-limiting Examples which illustrate specific embodiments thereof.

EXAMPLES

Physical properties for the samples in the Examples below were obtained using the following test procedures:

Vetterman Drum Wear: The Vetterman Drum test simulated wear according to ASTM D5417. The degree of wear exhibit by the samples is determined by a visual rating relative to photographic standards of wear from The Carpet and Rug Institute (CRI Reference Scale available from CRI, P.O. Box 2048, Dalton, Georgia, USA). Each of the common types of carpet construction has a corresponding set of photographic examples of unworn and worn samples. The wear levels are from 5 to 1, where 5 represents no visible wear and 1 represents considerable wear.

Static Compression: The static compression was determined by testing four samples from the material. Initial pile height of each carpet sample was determined under a load of 0.5 psi using the compressometer and methods as described above in determining Pile Height Retention. The carpet was compressed for 24 hours under 50 psi. The compression force was then removed and the carpet vacuumed and allowed to recover with no loading for another 24 hours, following which the final reading was done. The result was the average for the four samples reported as a percent of the original pile height. Testing and measurements were conducted at 70° F. and 65% relative humidity.

Mass on A1 Foil (Mass AF): The mass deposited on aluminum foil was determined by dissolving deposits using methanol, after which there was no residue remaining on the foil. The weight of the foil before and after methanol extraction was determined with the mass of the deposit in milligrams being determined by the difference between such weight determinations.

Amount of Cyclic Oligomers: The amount of cyclic oligomers were determined by HPLC techniques. Retention times were determined from known standards. The percent (%) oligomers present was assumed to be proportional to the area under the peak for each signal. Estimates of mass were determined by multiplying the percent of the component by the mass removed from the aluminum foil.

Example 1 comparative

Nylon-6 polymerized under a high dimer process was spun at 275° C. through a 58 hole trilobal spinneret. The spin beam was bicomponent and both extruders extruded the high dimer nylon-6. The polymer ratios from the two extruders (as determined by the polymer gear pump speed) produced a 20 wt. % sheath. The polymer throughput per hole was 3.44 grams per minute (g/min). At the spinneret, aluminum foil surrounded the fiber bundle. The amount and relative composition of deposits on the aluminum foil are reported in Table 1 below. This example gave some problems in spinning, requiring several stoppages.

Example 2 comparative

Commercial spinning grade nylon 6 (BS 700-F from BASF Corporation of Mt. Olive, N.J.) was spun at 275° C. through a 58 hole trilobal spinneret. The spin beam was bicomponent and both extruders extruded the commercial spinning grade nylon-6. The polymer ratios from the two extruders (as determined by the polymer gear pump speeds) produced a 20 wt. % sheath. The polymer throughput per hole was 3.44 grams per minute (g/min). The spinning speed (speed of the first driven roll in the take-up process) was 500 meters per minute (M/min). At the spinneret, aluminum foil surrounded the fiber bundle. The amount and relative composition of deposits on the aluminum foil are reported in Table 1 below. This example gave no problems in two hours of spinning.

Example 3 invention

A sheath-core bicomponent trilobal fiber was created using the apparatus of examples 1 and 2. Nylon-6 polymerized from a high dimer process formed the 80 wt. % by weight core and commercial spinning grade nylon-6 (BS-700F from BASF Corporation of Mt. Olive, N.J.) formed the 20 wt. % sheath. Both polymers were spun at 275° C. through a 58 hole trilobal spinneret. The spin beam was bicomponent. The polymer ratios from the two extruders (as determined by the polymer gear pump speed) produced a 20 wt. % sheath. The polymer throughput per hole was 3.44 grams per minute. The spinning speed (speed of the first driven roll in the takeup process) was 500 meters per minute. At the spinneret, aluminum foil surrounded the fiber bundle. The amount and relative composition of deposits on the aluminum foil are reported in Table 1. This example gave no problems in two hours of spinning.

TABLE 1

Residues from Examples 1–3

| Ex. No. | AF Mass (gm) | % Capro | % CD | % CT | Capro Mass (gm) | CD Mass (gm) | CT Mass (gm) |
|---|---|---|---|---|---|---|---|
| 1 | 42.2 | 3 | 92 | 5 | 1.4 | 38.8 | 2.1 |
| 2 | 11.2 | 5 | 80 | 14 | .6 | 9.0 | 1.6 |
| 3 | 20.0 | NS | 98 | 2 | NS | 19.5 | 0.5 |

Notes:
AF Mass = Mass on aluminum foil
Capro = Caprolactam
CD = cycli dimer
CT = cyclic trimer
NS = Not Sufficient signal to determine content

Example 4 invention

A sheath-core bicomponent trilobal fiber was created using the apparatus of examples 1 and 2. Nylon-6 polymerized from a high dimer process formed the 80 wt. % by weight core and commercial spinning grade nylon-6 (BAS-700F from BASF Corporation of Mt. Olive, N.J.) through a 58 hole trilobal spinneret. The spin beam was bicomponent. The polymer ratios from the two extruders (as determined by the polymer gear pump speed) produced a 20 wt. % sheath. The polymer throughput per hole was 3.44 grams per minute. The spinning speed (speed of the first driven roll in the take-up process) was 500 meters per minute. At the spinneret, aluminum foil surrounded the fiber bundle. The amount and relative composition of deposits on the aluminum foil are reported in Table 2. This example gave no problems in 3½ hours of spinning. The yarn was drawn to a draw ratio of 3:1 and wound on a winder at a speed of approximately 1600 meters per minute. Spinning and drawing were done in one step. This yarn was subsequently steam textured.

Two ends of this yarn were cabled and twisted to a nominal twist of 4.5 twists per inch. The cabled yarn was then autoclaved heatset using a heating cycle of 265° F.–240° F.–265° F.–240° F.–265° F. The yarn was then tufted into a ⅛ gage cut pile carpet with 40 ozs. of face fiber per square yard of carpet with a ½-inch pile height. Carpets were dyed to a light brown shade and coated with latex. Vetterman drum and static compression test results are reported in Table 2.

TABLE 2

| | Carpet Performance from Examples 4–7 | | | | |
|---|---|---|---|---|---|
| | Vetterman Drum Simulated Wear | | | | |
| | 5,000 Cycles | | 22,000 Cycles | | |
| | Visual Grade | Pile Height Retention (%) | Visual Grade | Pile Height Retention (%) | Static Compression (%) |
| Ex. 4 | 3–4 | 88 | 1–2 | 81 | 95 |
| Ex. 5 | 3 | 87 | 1–2 | 79 | 86 |
| Ex. 6 | 3–4 | 91 | 2–3 | 79 | 87 |
| Ex. 7 | 3–4 | 89 | 1–2 | 87 | 95 |

Example 5 invention

Example 4 was repeated, except that the nylon-6 with high dimer content is in a 50 wt. % core and the sheath of commercial spinning grade nylon-6 formed a 50 wt. % sheath. Spinning performance was very good. Carpet testing results are reported in Table 2.

Example 6 comparative

Examples 4 and 5 were repeated, except that the fibers consisted of 100% high cyclic dimer content nylon-6. Spinning performance was much poorer than that seen in Examples 4 and 5. Processing the fiber into carpets was fine and the wear and compression properties of the carpets is reported in Table 2.

Example 7

Comparative

Examples 4 and 5 were repeated, except that the fibers consisted of 100% commercial spinning grade nylon-6 BS-700F from BASF Corporation of Mt. Olive, N.J.). Spinning performance was equivalent to that seen in Examples 4 and 5. Processing the fiber into carpets was fine and the wear and compression properties of the carpets is reported in Table 2.

The data above demonstrate that bicomponent fibers according to this invention will exhibit properties that are comparable to fibers formed from 100% uncontaminated nylon-6.

Example 8 invention

Nylon 6 polymer (Ultramid® BS-700F nylon commercially available from BASF Corporation) and a regenerated polymeric material obtained from recycled nylon carpets having 90% nylon 6 and 10% dirt and backing contaminants are used in this Example 8. The materials are extruded using equipment as described in U.S. Pat. No. 5,244,614. The relative amounts of each component are 75 wt. % nylon 6 in the sheath and 25 wt. % recycled nylon 6 in the core. Final extruder zone temperatures for each polymer are 275° C. for the nylon 6 and 275° C. for the recycled nylon 6. The spin pack temperature is 270° C. The polymers are delivered to a spin pack designed using thin plates such as described in U.S. Pat. No. 5,458,972 (the entire content of which is incorporated hereinto by reference), particularly FIG. 4 thereof so as to form a trilobal bicomponent fiber having a concentric circular cross-section core. The fiber is cooled, drawn and textured in a continuous spin-draw apparatus (Rieter J0/10). The draw ratio is 2.8 and the winding speed is 2200 meters per minute.

Example 9 invention

Nylon 6 polymer (Ultramid® BS-700F nylon commercially available from BASF Corporation) and a regenerated polymeric material obtained from recycled nylon carpets having 90% nylon 6 and 10% dirt and backing contaminants are used in this Example 9. The materials are extruded using equipment as described in U.S. Pat. No. 5,244,614. The relative amounts of each component are 70 wt. % nylon 6 in the sheath and 30 wt. % recycled nylon 6 in the core. Final extruder zone temperatures for each polymer are 275° C. for the nylon 6 and 275° C. for the recycled nylon 6. The spin pack temperature is 270° C. The polymers are delivered to a spin pack designed using thin plates such as described in U.S. Pat. No. 5,458,972 so as to form a trilobal bicomponent fiber having a concentric circular cross-section primary core and a radially elongate, elliptically cross-section secondary core in each of the trilobal fiber legs. The fiber is cooled, drawn and textured in a continuous spin-draw apparatus (Rieter J0/10). The draw ratio is 2.8 and the winding speed is 2200 meters per minute.

Example 10 invention

It is known that recycled polymeric material will have some color variation (typically a shade of gray-green) due to the different colors and polymers between batches of recycled material. The recycled polymer is thus measured for color difference against a known color standard. Thereafter, a specified amount of carbon black is added to the recycled polymer to correct the color to the known standard color. The "color-leveled" recycled polymer could then be spun as a core in the fibers according to Examples 8 and 9.

Example 11 invention

The core material of post consumer recovered nylon 6 was processed using the techniques described in U.S. Pat. No. 5,535,945 (incorporated hereinto by reference) The starting materials were colored, backed carpets of nylon 6 face yarn obtained from carpets that had been worn and were being replaced. The carpet was ground and much of the backing material is separated via a centrifuge and a polymer filtration step. The resultant polymer material was approximately 95% nylon 6. The remaining 5% was composed of latex house dirt and possibly other contaminant components, as well as polypropylene and residual colorants.

The recovered nylon 6 was melt spun in the core of a sheath-core trilobal fiber. The sheath material was BS-700F (BASF Corporation, Mount Olive, N.J.) with no additives. Polymer temperatures were each 270° C. The sheath was 75% of the fiber by weight while the core was 25% of the fiber weight. The spinning apparatus was a bicomponent spin head that utilized thin plates such as those described in U.S. Pat. No. 5,344,297. A conventional one-step bulked continuous fiber (BCF) carpet drawing-texturing, and winding machine was used. Winding speed was approximately 2050 m/min. Physical properties of these yarns measured according to ASTM D 2256-97 appear in Table 3 below. The yarn had a medium green color.

Example 12 invention

Example 10 was repeated, except that approximately 1.60% of a green pigment mixture was added to the BS-700F nylon-6 in the sheath resulting in 1.2 percent pigment added to the total fiber. No colorant was added to the core material. These fibers were a darker green as compared to the fibers obtained in Example 10. Physical properties of these yarns are summarized in Table 3 below.

Example 13 comparative

Example 12 was repeated, except that the core of the fibers was bright uncolored BS-700F nylon-6. These fibers are a lighter shade of green as compared to the fibers obtained in Examples 11 and 12. Physical properties of the yarns are summarized in Table 3 below.

TABLE 3

Physical Properties of Fibers

| | Linear Density (denier) | Modification Ratio | Tenactiy (g/denier) | Breaking Elongation (% extension) | Modulus @ 5% extension (g/denier) |
|---|---|---|---|---|---|
| Ex. 11 | 1253 | 2.76 | 2.61 | 17.1 | 7.50 |
| Ex. 12 | 1241 | 2.74 | 2.72 | 35.6 | 6.80 |
| Ex. 13 | 1211 | 2.76 | 3.01 | 38.6 | 8.16 |

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A bicomponent fiber comprising a colored, recreated polymeric core surrounded by a virgin polyamide, colored sheath, said sheath being colored to an extent that the color of said regenerated polymeric core is not visible.

2. A fiber as in claim 1, wherein each of the core and sheath domains is nylon.

3. A fiber as in claim 2, wherein the nylon is nylon-6.

4. The bicomponent fiber of claim 1, comprising a core formed of a regenerated polymer having caprolactam cyclic dimer and a sheath entirely surrounding said core, wherein said core includes a color leveler.

5. The fiber of claim 4, wherein the color leveler is carbon black.

6. A fiber as in claim 4, in the form of a trilobal, concentric sheath-core bicomponent fiber.

7. A fiber as in claim 6, wherein the nylon sheath is nylon 6 or nylon 6/6.

8. A fiber as in claim 7, wherein the core comprises 50% by weight or greater of the fiber.

9. A fiber as in claim 8, wherein the sheath comprises greater than about 75% by weight of the fiber, and the core comprises less than about 25% by weight of the fiber.

10. A fiber as in claim 1 or 4, which is drawn greater than 10%.

11. A fiber as in claim 1 or 4, which is a bulked continuous carpet fiber.

12. A fiber as in claim 1 or 4, which is a staple fiber.

13. A yarn comprised of a plurality of carpet fibers as in any one of claims 1–4.

14. A fabric comprised of a plurality of fibers as in any one of claims 1–4.

* * * * *